United States Patent [19]

Appelbaum et al.

[11] Patent Number: 4,699,375

[45] Date of Patent: Oct. 13, 1987

[54] SYSTEM FOR SKIP ROPE EXERCISING

[76] Inventors: Paul Appelbaum, P.O. Box 27006, Denver, Colo. 80227; Ronald Kozlow, 10458 Purgatorie Peak, Littleton, Colo. 80127

[21] Appl. No.: 679,003

[22] Filed: Dec. 6, 1984

[51] Int. Cl.[4] ..... A63B 5/22; A63B 5/20

[52] U.S. Cl. ..... 272/74; 272/75; 272/DIG. 5

[58] Field of Search ..... 272/74, 75, 70, DIG. 6, 272/DIG. 5; 324/117 H

[56] References Cited

U.S. PATENT DOCUMENTS

| | | | |
|---|---|---|---|
| 181,726 | 8/1876 | Savage et al. | 272/75 |
| 932,331 | 8/1909 | Russell et al. | 272/75 X |
| 1,189,307 | 7/1916 | Stokes et al. | 272/75 |
| 4,216,956 | 8/1980 | Yamamura et al. | 272/DIG. 5 X |
| 4,336,933 | 6/1982 | Appelbaum | 272/70 |
| 4,378,111 | 3/1983 | Tsuchida et al. | 272/DIG. 5 X |
| 4,477,070 | 10/1984 | Appelbaum | 272/70 |

*Primary Examiner*—Robert A. Hafer
*Assistant Examiner*—Kathleen D'Arrigo
*Attorney, Agent, or Firm*—Charles C. Corbin

[57] ABSTRACT

A system for exercising with a skip-rope including a tread mat having a sensor embedded therein that is responsive to the proximate passage of the skip-rope and read-out instrumentation connected to the sensor for counting the number of skips.

15 Claims, 2 Drawing Figures

SYSTEM FOR SKIP ROPE EXERCISING

BACKGROUND

Along with the general population's increase in health awareness and interest in fitness has come an increasing need for exercise devices and systems that allow the user to pursue the benefits of aerobic conditioning in a way that is fun, rewarding, easy to use and relatively inexpensive. Over the years a fairly popular method of conditioning has been the practice of exercising with a skip rope, however, there are drawbacks associated with the use of the conventional skip rope which have heretofore tended to limit one's choice of this highly beneficial exercise device. The skip rope user must be cautious to avoid harmful shock to the feet and lower extremities. In addition, in order to enhance the popularity of skipping, there remains a need for satisfactory means by which the exercise may receive feedback concerning the number of skips he or she has accumulated, thereby facilitating goal-setting and the feeling of accomplishment when one's goals are attained. One known skipping device that records skips accumulated is sold under the trademark LIFELINE and counts skips by means of a mechanical counter contained within the hub of the skip rope handle. While this device and similar ones provide the number of accumulated skips, the exerciser is unable to get instantaneous feedback on number of skips during the skipping process. Rather, he or she must stop and interrupt the process in order to read the counter.

SUMMARY OF INVENTION

In view of the foregoing it is an object of the present invention to provide a novel system that permits the skip rope exerciser to receive performance feedback in the form of a visual display of numbers of skips accomplished.

Another object is to provide a system that gives the skip rope exerciser instantaneous feedback.

A further object is to provide a system that protects the skipper's lower extremities against pounding.

Accordingly, the present invention is a system that utilizes a skip rope having a metallic component at its mid-portion, a cushioned, shock absorbing under-mat, and a feedback display panel and associated instrumentation adjoining the mat. There is embedded in the mat sensor means for detecting when the metallic portion of the skip rope passes closely to the mat surface, and this sensing means is connected to the feedback instrumentation and panel which counts and clearly displays the number of skip rope passes.

In various modifications of the invention the metallic portion of the skip rope may be non-ferrous, ferrous, or magnetized ferrous, and the sensor is an electrical coil connected to an electric circuit which is responsive to a change in coil inductance or to a change in the magnetic field in the coil vicinity caused by the passing skip rope.

DETAILED DESCRIPTION OF THE DRAWINGS

Figure 1:
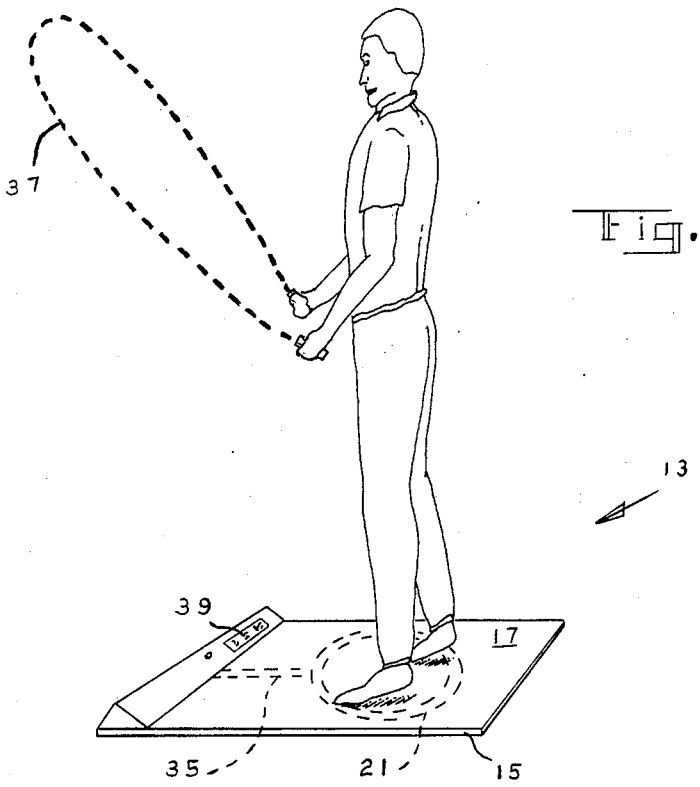
FIG. 1 is a view in perspective showing the invention in use.
Figure 2:
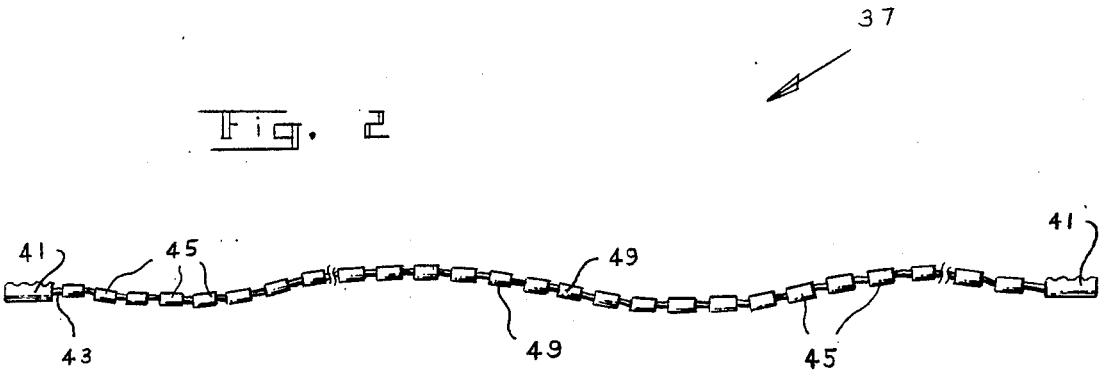
FIG. 2 is a fragmented plan view of the skip rope of the invention.

As shown in FIG. 1 the invention includes tramping mat 13 which has a shock-absorbing layer 15 to which is bonded a top layer 17 of reinforced PVC sheet material. The surface of top layer 17 has a smooth finish which minimizes friction between it and the skip rope 37. Between top layer 17 and layer 15 lies an electrical coil 21 that comprises several turns of copper wire arranged in a generally circular pattern lying in the general tramping zone of the exercising person. Wire leads 35 connect the coil 21 to instrumentation circuitry of conventional design (not shown) which feeds a digital read-out LCD display plate 39 on panel 40 that is oriented upwardly to be easily read by the exerciser. The skip rope 37 is preferably of the construction shown in FIG. 2 having handles 41 with inner rope 43 extending therebetween and with a plurality of tubular plastic sections 45 entrained thereon. There are two metal sections 49 located near the middle of rope 37. These sections 49 are preferrably steel and in one modification of the invention are magentized.

In the preferred embodiment coil 21 is connected to instrumentation circuitry (conventional) that includes an rf oscillator whose frequency changes in response to the change in inductance of coil 21 caused when metal sections 49 come close to coil 21. In another embodiment the circuitry is responsive to the variation in the amplitude of the oscillator caused by the change in inductance of coil 21. In a further variation, a magnetic field is maintained in coil 21 which is connected to a high gain af amplifier, the output of which is fed to a relay and then to the LCD readout counter. This circuitry is responsive to the current impulse generated in coil 21 when its magnetic lines of force are cut by the passage of metal sections 49. In a similar embodiment there is circuitry responsive to the current impulse that is induced in coil 21 when metal sections 49, which have been magnetized, pass coil 21.

In one further embodiment of the invention, the exerciser can receive pulse rate feedback by means of a pulse sensor, not shown, located on a handle 41 of the skip rope 37, which sensor is connected to instrumentation in the hub of a handle 41 for transmitting a signal carrying the pulse rate information. A receiver circuit, which may include coil 21, is located within panel 40, and feeds a digital read-out display plate 53.

When the invention is to be used as depicted in FIG. 1 the exerciser sets the readout counter to zero and will skip on mat 13 using skip rope 37. The exerciser will easily observe on display plate 39 the number of skips being accumulated as the skipping proceeds. He may also monitor his pulse rate on display plate 53.

As many changes could be made in the above constructions without departing from the scope of the invention, it is intended that all matter contained in the foregoing description and accompanying drawings shall be interpreted as illustrative and not in a limiting sense.

What is claimed is:

1. System for performing skip-rope exercises comprising:

a. a skip-rope having a mid-portion that has a metallic component; and b. a floor mat having a generally flat surfaced major portion for being tread upon by an exerciser while using said skip-rope, said major portion embodying an electrical coil wherein an electrical response is thereby created in said coil when said mid-portion passes in close proximity to said coil, and a read-out display portion adjoining said major portion having instrumentation which is responsive to, and which reads out the number of passes to said coil made by said skip-rope mid-portion.

2. System as defined in claim 1 wherein said metallic component is ferrous.

3. System as defined in claim 1 wherein said metallic component is magnetized.

4. System as defined in claim 1 wherein said instrumentation includes a high-gain af amplifier connected to said coil, said amplifier feeding to a relay which feeds to a counter circuit.

5. System as defined in claim 1 wherein said instrumentation includes a rf oscillator which will shift frequency in response to a change in inductance of said coil.

6. System as defined in claim 1 wherein said instrumentation includes a resonant rf tank circuit responsive to a change in inductance of said coil.

7. System as defined in claim 1 wherein the upper surface of said major portion has a smooth, low friction finish.

8. System as defined in claim 1 wherein said display portion has a display panel which lies generally horizontally in close vicinity to said major portion and faces upwardly.

9. System as defined in claim 1 wherein display portion has a display panel which lies in close vicinity to said major portion and which faces obliquely upwardly.

10. System as defined in claim 1 wherein said display portion includes a pulse-rate sensor and read-out.

11. System as defined in claim 1 wherein said major portion is composed of cushioned, shock absorbing material.

12. System as defined in claim 1 including means embodied in said skip rope for sensing an exerciser's pulse rate and for transmitting a signal carrying said pulse rate information, and means located in said display portion for receiving and processing said signal and displaying said pulse rate.

13. System as defined in claim 12 wherein means for receiving said signal includes said electrical coil.

14. System as defined in claim 12 wherein said sensing means includes instrumentation embodied in the hub of a handle of said skip rope.

15. System as defined in claim 1 including means embodied in said skip rope sensing an exerciser's pulse rate and instrumentation connected to said sensing means and contained in the hub of a handle of said skip rope for reading out said pulse rate.

* * * * *